US007543397B2

(12) United States Patent
Kilgore et al.

(10) Patent No.: US 7,543,397 B2
(45) Date of Patent: Jun. 9, 2009

(54) ARTICLE OF FOOTWEAR FOR FENCING

(75) Inventors: Bruce J. Kilgore, Lake Oswego, OR (US); Ciro Fusco, Portland, OR (US)

(73) Assignee: Nike, Inc., Beaverton, OR (US)

( * ) Notice: Subject to any disclaimer, the term of this patent is extended or adjusted under 35 U.S.C. 154(b) by 267 days.

(21) Appl. No.: 11/536,103

(22) Filed: Sep. 28, 2006

(65) Prior Publication Data

US 2008/0078102 A1 Apr. 3, 2008

(51) Int. Cl.
*A43C 11/00* (2006.01)

(52) U.S. Cl. ..... 36/50.1; D2/969

(58) Field of Classification Search ..... 36/51, 36/50.1, 45, 55, 88; D2/969, 923
See application file for complete search history.

(56) References Cited

U.S. PATENT DOCUMENTS

| | | | | |
|---|---|---|---|---|
| 660,284 | A | | 10/1900 | Webber |
| 1,542,848 | A | | 6/1925 | Barnes |
| 2,088,851 | A | | 8/1937 | Gantenbein |
| 2,190,579 | A | * | 2/1940 | Wash ..... 36/7.1 R |
| 2,241,653 | A | | 5/1941 | Weyenberg |
| 2,244,030 | A | | 6/1941 | Teehan |
| 2,369,254 | A | | 2/1945 | Roman |
| 3,589,038 | A | | 6/1971 | Salier |
| 3,618,235 | A | | 11/1971 | Cary, Jr. |
| 3,626,610 | A | | 12/1971 | Dassler |
| 3,650,051 | A | | 3/1972 | Sass |
| 3,703,775 | A | | 11/1972 | Gatti |
| 4,080,745 | A | | 3/1978 | Torrance |
| 4,255,876 | A | | 3/1981 | Johnson |
| 4,308,672 | A | | 1/1982 | Antonious |
| 4,370,818 | A | | 2/1983 | Simoglou |
| 4,373,275 | A | | 2/1983 | Lydiard |
| 4,517,753 | A | | 5/1985 | Rosenbaum et al. |
| 4,616,432 | A | | 10/1986 | Bunch et al. |
| 5,167,084 | A | * | 12/1992 | Flammier ..... 36/117.2 |
| 5,289,646 | A | | 3/1994 | Kiyosawa |
| 5,337,493 | A | | 8/1994 | Hill |
| 5,437,112 | A | | 8/1995 | Johnston |
| D364,266 | S | | 11/1995 | Orzeck |
| D381,495 | S | | 7/1997 | Avar |
| 5,704,138 | A | | 1/1998 | Donnadieu |

(Continued)

FOREIGN PATENT DOCUMENTS

| | | |
|---|---|---|
| FR | 2534459 | 4/1984 |

*Primary Examiner*—Jila M Mohandesi
(74) *Attorney, Agent, or Firm*—Plumsea Law Group, LLC

(57) ABSTRACT

An article of footwear is disclosed. The article of footwear includes a multi-layered upper. A bootie configured to fit snugly about the foot of the wearer forms the interior of the upper. An outer covering substantially encases the bootie and is attached to the bootie only along a lateral side of the upper. The outer covering includes a split forming an opening on the lateral side of the upper, with the split in the outer covering extending into the small toe region of the upper. The opening is adjustable to tighten the shoe around the foot of the wearer, so a lacing system is provided coincident with the opening. A flap is positioned between the outer covering and the bootie underneath the opening. The flap is secured to the outer covering and the bootie on a lateral side of the opening.

22 Claims, 6 Drawing Sheets

U.S. PATENT DOCUMENTS 5,826,354 A 10/1998 Garbujo
D452,769 S * 1/2002 Jacobs ..... D2/908
6,430,847 B2 8/2002 Fusco et al.
6,449,879 B1 9/2002 Fallon et al.
6,747,991 B1 7/2004 Sussman
6,839,987 B2 1/2005 Basso
6,954,996 B2 10/2005 Borsoi
D545,541 S * 7/2007 Belley et al. ..... D2/969
2004/0118019 A1 6/2004 Ito
2004/0205982 A1 * 10/2004 Challe ..... 36/55
2005/0198866 A1 9/2005 Wiper et al.
2005/0284002 A1 12/2005 Aveni

* cited by examiner

ARTICLE OF FOOTWEAR FOR FENCING

BACKGROUND OF THE INVENTION

1. Field of the Invention

The present invention relates generally to an article of footwear and more particularly to an asymmetric article of footwear.

2. Description of Related Art

In many sports, an athlete uses his or her feet in an asymmetric fashion, where different parts of the foot are used at varying times for different purposes, either intentionally or unintentionally. For example, a runner develops unique wear patterns on the outsoles of his or her running shoes due to how a particular runner impacts and rolls the shoes on the ground with each stride. Each runner's wear pattern will be slightly different, depending upon how the runner subconsciously chooses to control the motion of his or her feet for a comfortable and stable running experience.

In another example, the motions of the feet are asymmetric for a more intentional purpose, such as in fencing. The basic moves of fencing include lunging forward from an upright position. The direction of the forward motion is selected by the leading foot, which is lifted during the lunge and then impacts the fencing surface. The trailing foot anchors and stabilizes the fencer, and typically slides on the fencing surface for much of the lunge. Upon retreating, both feet are typically dragged across the fencing surface. During a fencing bout, the leading foot guides the play by rolling, flexing, and dragging in a number of directions. The trailing foot also flexes and drags, but in a fewer number of positions. The toe region of the leading foot is particularly flexed and dragged, with the medial side of the toe region being dragged more than the lateral side of the toe region.

These typical and asymmetrical fencing foot motions result in wear patterns that vary over the shoes. The shoe on the leading foot will experience wear on the heel, due to impact and on the medial side toe region, due to dragging. The shoe on the trailing foot will experience more uniform wear.

Asymmetric foot motions are not only used by athletes. For orthopedic reasons, a foot may drag on one side more than on the other. For example, if a person has limited use of one foot or leg, the foot may drag, causing one side of the shoe to wear more significantly than the other. Such a situation may occur due to accident, disease, childhood conditions, such as being pigeon-toed or bow-legged, or the like.

Efforts have been made to account for asymmetrical motions between the feet in fencing shoes. For example, U.S. Pat. No. 6,430,847 discloses using different shoes for the leading and trailing foot, to account for the asymmetric motions of one foot with respect to the other foot. This is to allow each foot to perform optimally.

However, there remains a need in the art for a shoe which accounts for the asymmetric motions of a foot, such as how the leading foot of a fencer tends to be dragged more on the medial side of the toe region and flexed more on the lateral side of the toe region.

SUMMARY OF THE INVENTION

The invention provides an article of footwear with an asymmetric design. In one aspect the invention provides an article of footwear comprising a bootie forming an interior of an upper, an outer layer substantially covering the bootie. The outer layer includes an opening on a lateral side of the article of footwear, and the bootie is attached to the outer layer only on the lateral side of the article of footwear.

In another aspect, a portion of the opening is adjustable.

In another aspect, a lacing system is disposed on or around the opening.

In another aspect, the opening extends to the sole of the article of footwear in a toe region.

In another aspect, the bootie is configured to fit snugly around a foot of a wearer.

In another aspect, a flap is positioned between the outer layer and the bootie, the flap being attached to the bootie and the outer layer on one side of the opening.

In another aspect, the flap is attached to the bootie on a medial side of the opening.

In another aspect, the invention provides a fencing shoe comprising an upper including an outer covering having a split extending to a toe region on a lateral side of the fencing shoe, a cup outsole attached to the upper, the cup outsole having a rim extending over a portion of the upper. An extension of the outsole extending at least partially over a toe region on a medial side of the fencing shoe, and a gap is formed in the cup outsole to expose the split.

In another aspect, the outsole is rounded and thickened in a heel region of the fencing shoe.

In another aspect, the extension of the outsole is rounded and smooth.

In another aspect, the outsole is made of a smooth, resilient material.

In another aspect, the outsole is made of TPU.

In another aspect, an adjustment system is disposed on or near the split for adjusting an opening of the split.

In another aspect, the adjustment system comprises at least one of a lacing system, a hook-and-eye closure system, or a slide fastener.

In another aspect, a portion of the opening of the split is fixed.

In another aspect, the invention provides a multi-layered upper for an article of footwear comprising an inner layer configured to substantially encase a foot, an outer layer covering at least a portion of the inner layer, the outer layer having an opening disposed on a lateral side of the upper. A middle layer is disposed between the inner layer and the outer layer, where the middle layer is positioned underneath the opening.

In another aspect, the opening extends to an upper-sole interface.

In another aspect, the inner layer is displaceable relative to the outer layer.

In another aspect, the inner layer is attached to the outer layer only on a lateral side of the opening.

In another aspect, the inner layer is attached to the middle layer on a medial side and a lateral side of the opening.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
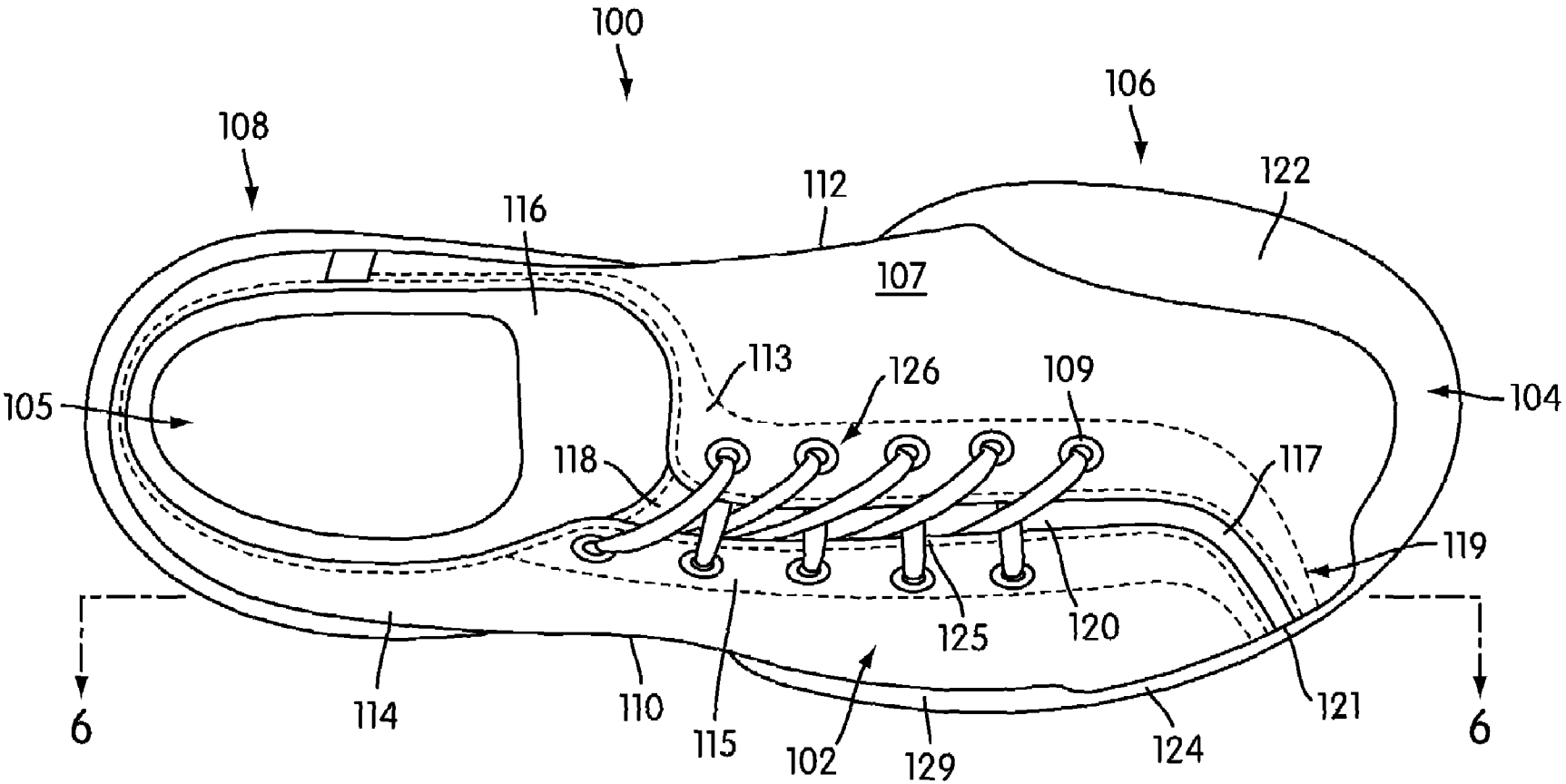
FIG. 1 is a schematic top view of a preferred embodiment of an asymmetric article of footwear.

FIG. 1 is a schematic top view of an asymmetric article of footwear 100. In one embodiment, article of footwear 100 is an athletic shoe for use in a sport requiring asymmetric motions of the feet, such as fencing, although article of footwear 100 can also be for other purposes. The figures show only a right shoe; a pair of shoes is formed by including a left shoe which is substantially a mirror image of the right shoe.

Article of footwear 100 generally includes an upper 102 affixed to an outsole 104 by any method, such as with an adhesive. Both upper 102 and outsole 104 are asymmetric in design to provide sliding capabilities and wear-resistance while maintaining flexibility, especially in a toe region 106 of article of footwear 100, and impact absorption capabilities, especially in a heel region 108 of article of footwear 100. Outsole 104 is preferably a cup-type outsole with a rim 129 extending at least slightly over upper 102 around the perimeter of article of footwear 100. In other embodiments, outsole 104 may extend over upper 102 in only selected positions or not at all.

Figure 5:
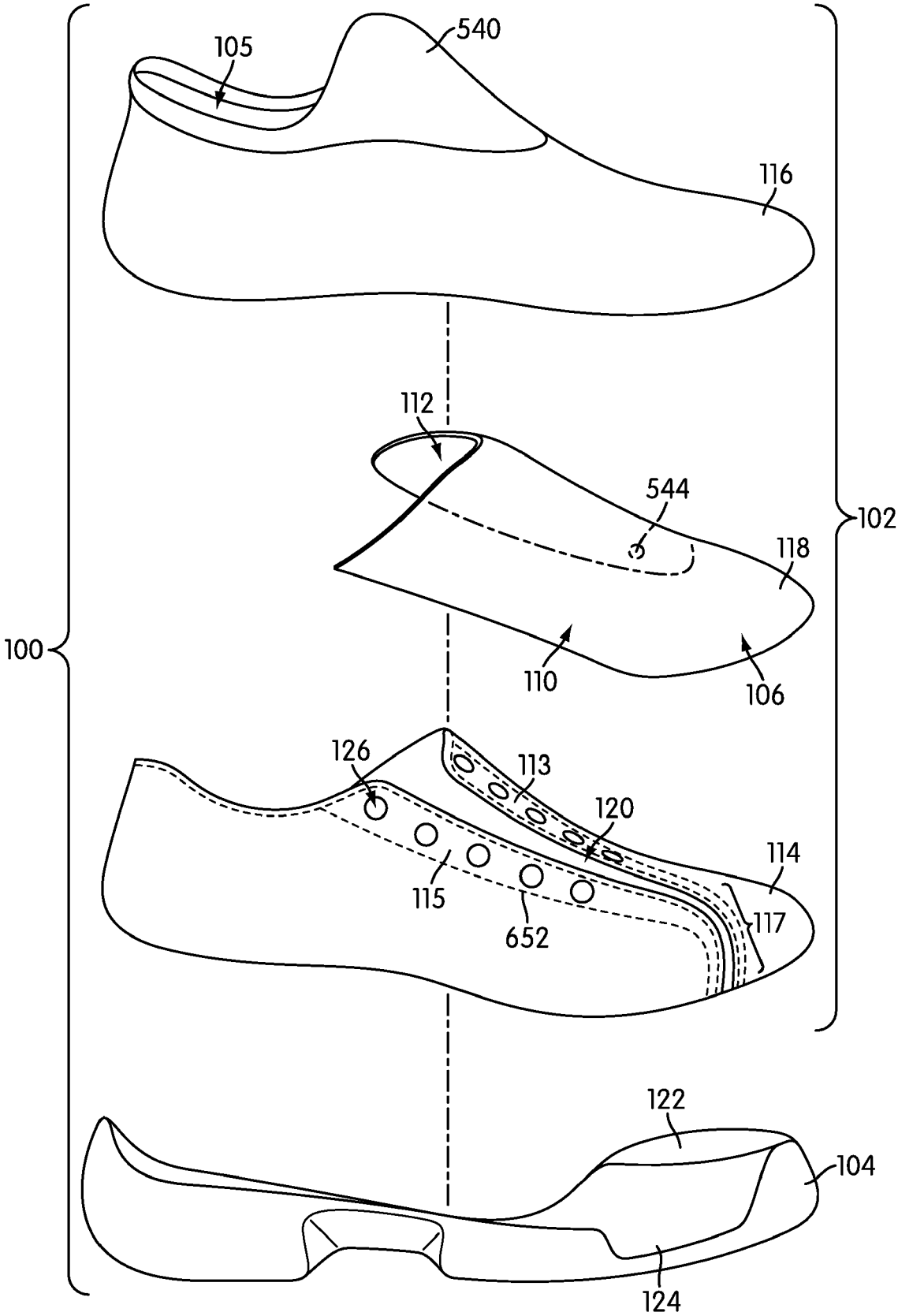
FIG. 5 is a schematic exploded assembly view of a preferred embodiment of an article of footwear, shown from the lateral side.

Upper 102 is preferably formed from three layers: a bootie 116 forming a sock-like interior of upper 102, an outer covering 114 which covers a substantial portion of bootie 116 and forms the exterior surface of upper 102, and a flap 118 positioned between bootie 116 and outer covering 114. The layers of upper 102 are more fully described below with regard to FIG. 5.

Upper 102 is asymmetrically divided by a split or opening 120 formed in outer covering 114 on a lateral side 110 of article of footwear 100. Opening 120 is preferably a cut formed entirely through outer covering 114, SO that a forefoot region 107 is separated into a medial side portion 113 and a lateral side portion 115. Opening 120 increases the flexibility of outer covering 114 in toe region 106 so that the toes of a wearer can move more easily through a greater range of motion. Preferably, opening 120 extends from a lateral side of foot insertion opening 105 to an upper-sole interface 121 in the vicinity of a small toe region 119 of article of footwear 100. Small toe region 119 generally corresponds to the wearer's small toe. The positioning of opening 120 relative to small toe region 119 may vary. However, the position of opening 120 is preferably so that the small toe of the wearer rests below lateral side portion 115 and that the remainder of the toes of the wearer rest below medial side portion 113.

In this embodiment, a first portion 125 of opening 120 is adjustable. For example, a wearer may wish to enlarge opening 120 during foot insertion or to make article of footwear 100 more comfortable. Similarly, a wearer may wish to decrease the size of opening 120, such as to tighten article of footwear 100 following foot insertion. In this embodiment, the edges of medial side portion 113 and lateral side portion 115 do not meet, although in other embodiments, the edges could be drawn together to contact one another. In the embodiment shown in FIG. 1, flap 118 is visible between the edges of medial side portion 113 and lateral side portion 115. An adjustment system 126 is provided to draw medial side portion 113 and lateral side portion 115 together and to maintain the relative positioning of medial side portion 113 and lateral side portion 115. In this embodiment, adjustment system 126 is a lacing system which includes a series of eyeholes 109 threaded with a lace 111. However, in other embodiments, adjustment system 126 may include a hook-and-eye closure system, such as Velcro®, a sliding closure, such as a zipper, or the like.

In some embodiments, the entire length of opening 120 may be adjustable. However, in this embodiment, a portion 117 of opening 120 near sole-upper interface is fixed in position. In fixed portion 117, medial side portion 113 and lateral side portion 115 are affixed to at least one of flap 118 and bootie 116. Medial side portion 113 and lateral side portion 115 may be fixed in position by any method known in the art, such as with an adhesive or by stitching.

In this embodiment, a portion or extension 122 of outsole 104 extends over a medial side of toe region 106. Extension 122 is preferably a smooth extension of outsole 104 that allows the wearer to more easily slide or drag medial side 112 on the ground. This type of sliding motion is seen in sporting events such as lunging in fencing. Extension 122 also prevents wear or damage to upper 102 when article of footwear 100 is dragged in the above-described manner. Affixing extension 122 to upper 102 increases the stiffness of upper 102. The increased flexibility provided by opening 120 may be used to offset the decrease in flexibility on medial side 112 of article of footwear 100.

Figure 2:
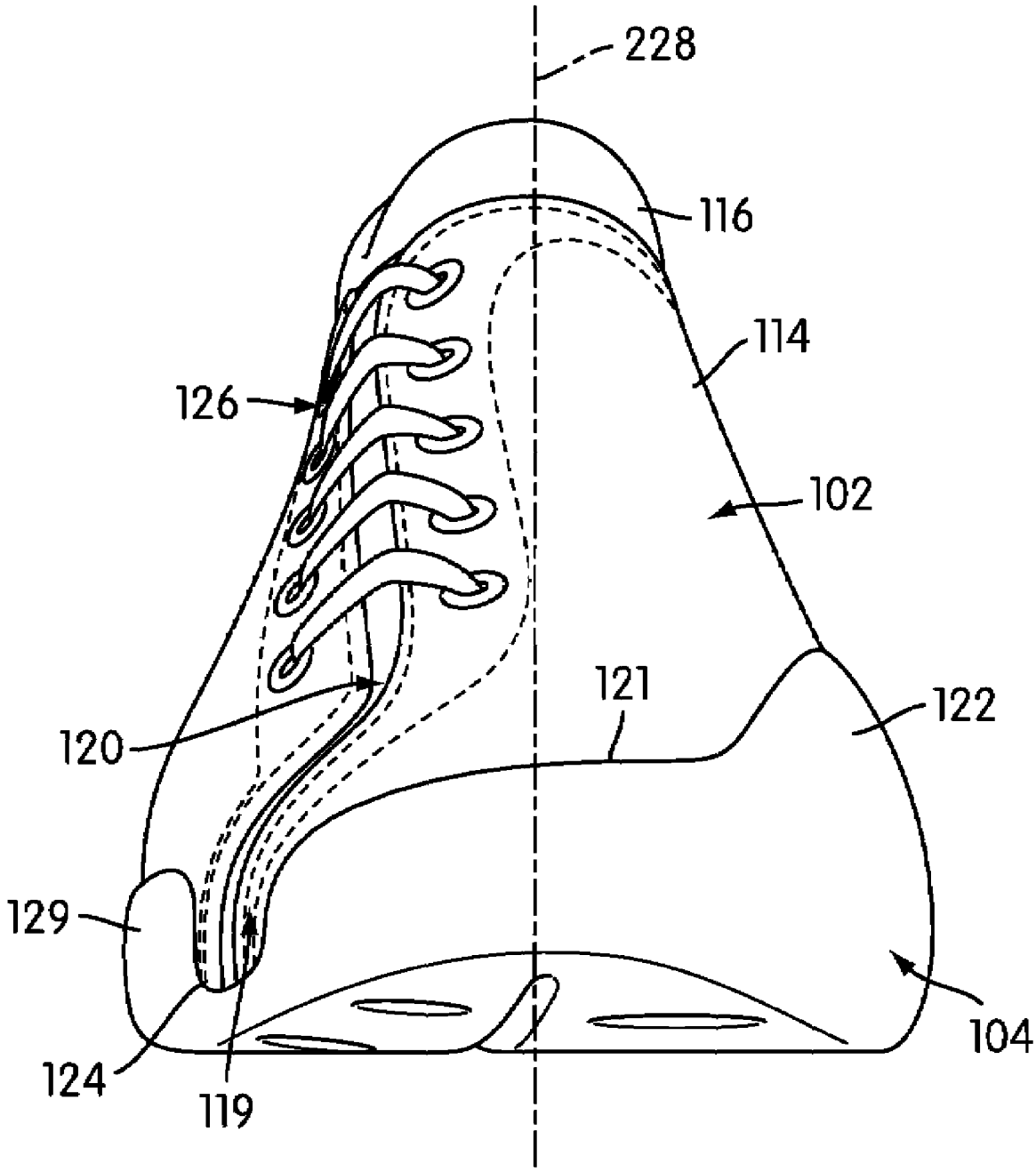
FIG. 2 is a schematic front view of a preferred embodiment of an article of footwear.

As shown in FIG. 2, the asymmetry of upper 102 and outsole 104 are complementary on opposite sides of a centerline 228. Stiffening on medial side 112 due to the extension of outsole 104 is matched by an increase in flexibility on lateral side 110 due to opening 120 and/or a reduction in the extent of the coverage of upper 102 by outsole 104. As outsole 104 in this embodiment is preferably a cup-type outsole, a rim 129 of outsole 104 extends over upper 102. A gap 124 is preferably formed in outsole 104 to decrease the stiffness of outsole 104 in small toe region 119 and to accommodate and expose opening 120. Gap 124 is preferably a notch or cutout formed in rim 129.

Figure 3:
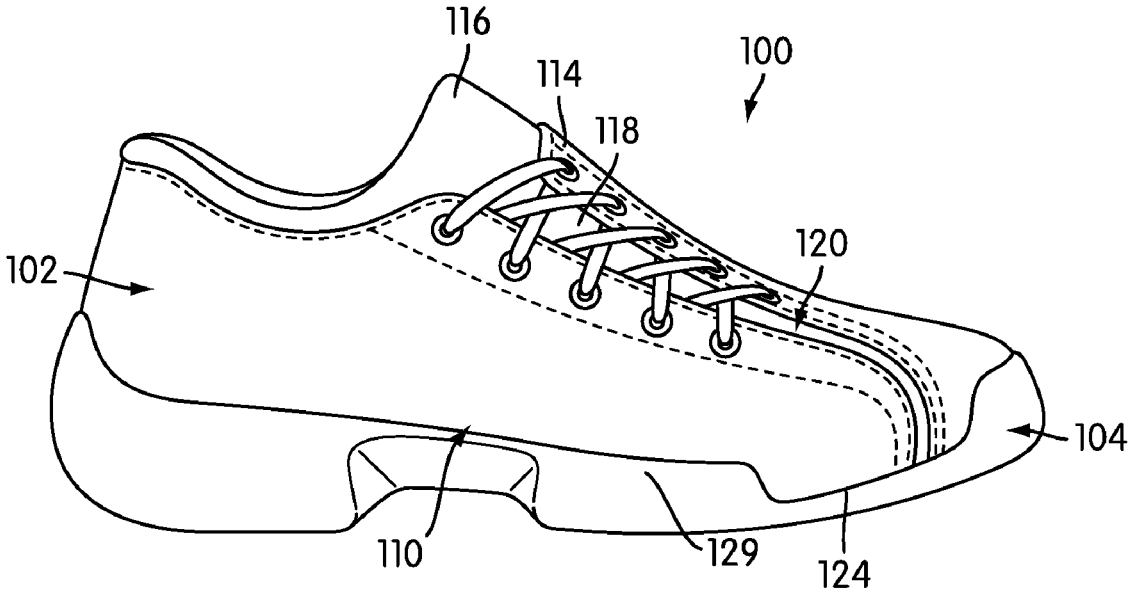
FIG. 3 is a schematic lateral side view of a preferred embodiment of an article of footwear.
Figure 4:
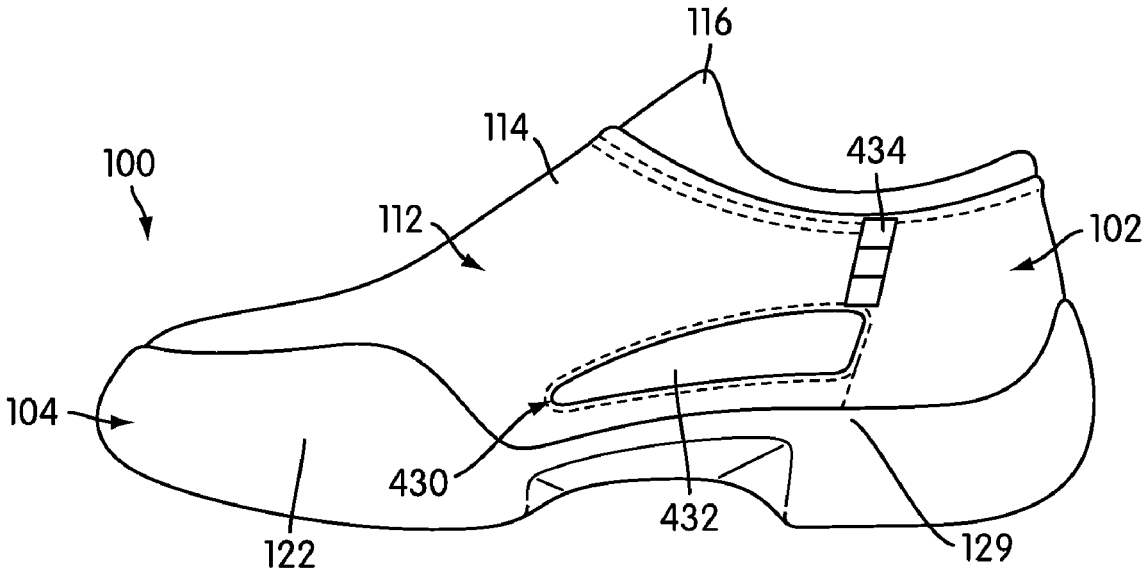
FIG. 4 is a schematic medial side view of a preferred embodiment of an article of footwear.

The asymmetry of article of footwear 100 is further shown in FIGS. 3 and 4, which show lateral side 110 and medial side 112 of article of footwear 100, respectively. On lateral side 110, rim 129 of outsole 104 includes gap 124 for increased flexibility, while medial side 112 is stiffened by outsole extension 122. Further, outer covering 114 includes opening 120 for increased flexibility on lateral side 110 which exposes flap 118, while medial side 112 includes an optional ventilation opening 430 for increased breatheability of article of footwear 100.

Ventilation opening 430 can be formed by removing a portion of the material of outer covering 114 in this embodiment, although in other embodiments, outer covering 114 may be split or cut without removing material. Ventilation opening 430 may be left open to expose a portion of bootie 116, or ventilation opening 430 may be filled by a porous material 432 which allows air to flow into and out of article of footwear 100. For example, material 432 may be a woven material, either natural or synthetic, such as cotton, wool, or nylon affixed to outer covering, such as by stitching or with an adhesive. Finally, an optional decorative element 434 may be included on one or both sides 110, 112. In this embodiment, decorative element 434 is embroidery stitched only on medial side 112 of article of footwear 100. However, decorative element 434 may be any type of decorative element known in the art, such as a decal affixed to outer covering 114 with stitching or an adhesive, a stamp or similar dye-based design imprinted onto outer covering 114, or the like.

As discussed above and shown in FIGS. 5 and 6, in which the lace has been removed from the figures for clarity, upper 102 preferably includes a multi-layer construction to enhance the flexibility of article of footwear 100 and to increase the range of motion of the foot of the wearer by allowing greater freedom of movement within article of footwear 100. In this embodiment, bootie 116 preferably snugly fits and substantially surrounds the foot of a wearer to form the interior of article of footwear 100. Bootie 116 is sock-like in construction, in that bootie 116 is able to hug the contours of the foot of the wearer. Bootie 116 is preferably made from at least two layers of a woven material, either separate pieces of material affixed together, such as by stitching, or a single piece of material folded and the free ends attached, such as by stitching. For example, bootie 116 may be made from a knitted synthetic material, such as nylon, or a natural material, such as cotton or wool. For additional comfort, bootie 116 also preferably includes a cushioned collar 540 which surrounds foot insertion opening 105. Cushioned collar 540 is preferably made of the same material as the remainder of bootie 116 with a low density foam or similar padding material inserted between the layers of bootie 116 and affixed in position, such as by stitching or with an adhesive.

In this embodiment, bootie 116 is preferably substantially covered by outer covering 114, with a portion of cushioned collar 540 remaining exposed. Outer covering 114 is preferably made of a non-woven material which is capable of withstanding wear and protecting the foot from exposure. For example, outer covering 114 may be made of a natural material, such as leather or suede, a synthetic material, such as vinyl, or a combination of materials. The stiffness provided by outer covering 114 is reduced by the inclusion of opening 120, as discussed above.

Flap 118 is a portion of material positioned between outer covering 114 and bootie 116. On lateral side 110, flap 118 is shaped and contoured to match the shape of outer covering 114 from toe region 106 to a point near foot insertion opening 105. However, on medial side 112, flap 118 is preferably smaller, with an irregular shape which does not extend into toe region 106. Flap 118 is preferably made of a non-woven material similar to that of outer covering 114. More preferably, flap 118 is made from ethylene vinyl acetate (EVA). Flap 118 protects the foot of the wearer and bootie 116 from being abraded by adjustment system 126 and the relative movement of medial and lateral portions 113, 115. Additionally, flap 118 is positioned underneath opening 120 to prevent bootie 116 from exposure through opening 120 for protective and aesthetic considerations.

Figure 6:
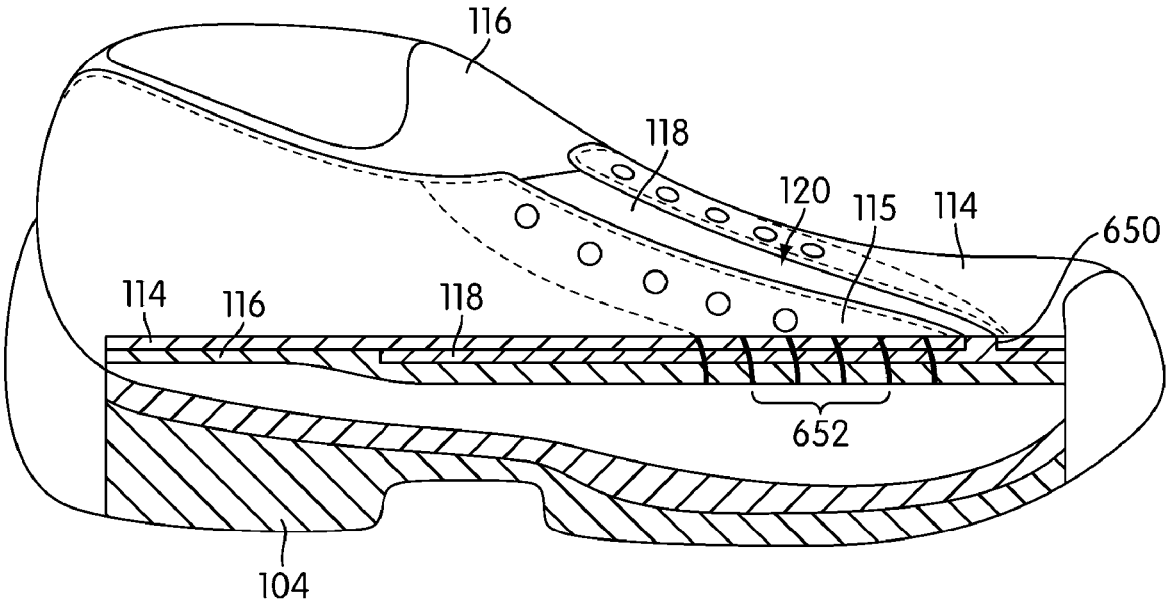
FIG. 6 is a schematic partial cutaway view of the lateral side of a preferred embodiment of an article footwear.

The individual layers of upper 102 are preferably relatively free-moving with respect to each other. For example, bootie 116 is preferably relatively free-floating within outer covering 114, with bootie 116 affixed to outer covering 114 only on lateral side portion 115 of opening 120. Flap 118 is also preferably affixed to outer covering 114 at the same position. As shown in FIG. 6, which is a partial cutaway of lateral side 110 of article of footwear 100 showing exaggerated layers for clarity, a series of stitches 652 connect all three layers 114, 116, 118 on lateral portion 115. In other embodiments, the connection of layers 114, 116, 118 may be affected by any means known in the art, such as with an adhesive.

Referring again to FIG. 5, bootie 116 is preferably attached to outer covering 114 only by stitches 652, while flap 118 is preferably also stitched or otherwise attached to both medial and lateral side portions 113, 115 of outer covering 114 in fixed portion 117. As such, bootie 116 remains loosely constrained by outer covering 114. The wearer can therefore flex and move the foot within bootie 116, which can move and displace slightly with respect to outer covering 114. Therefore, the wearer has a greater degree of motion with article of footwear 100 than would be achievable if the motion were entirely directed by the stiffer material of outer covering 114. Optionally, bootie 116 may be attached to flap 118 on medial side 112 of flap 118, such as with a stitch 544, or by any means known in the art, such as with an adhesive. This attachment assists in maintaining the position of flap 118 over bootie 116 to protect bootie 116 and the foot of the wearer from irritation or abrasion by opening 120.

Figure 7:
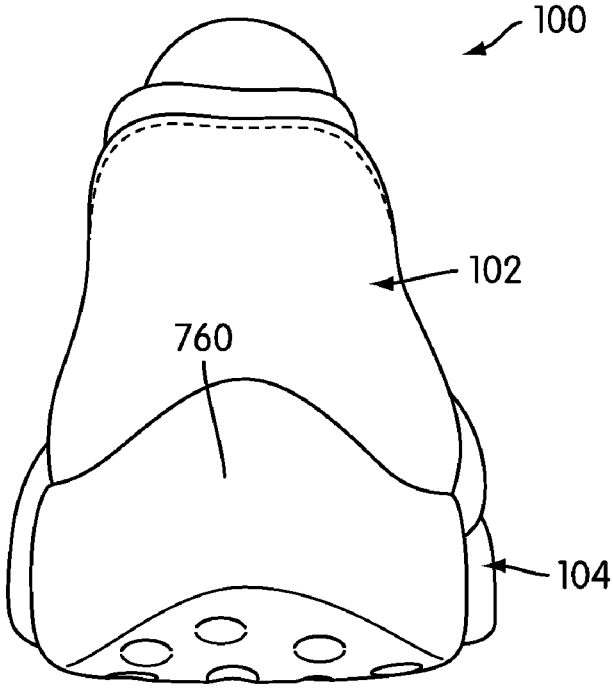
FIG. 7 is a schematic rear view of a preferred embodiment of an article of footwear.
Figure 8:
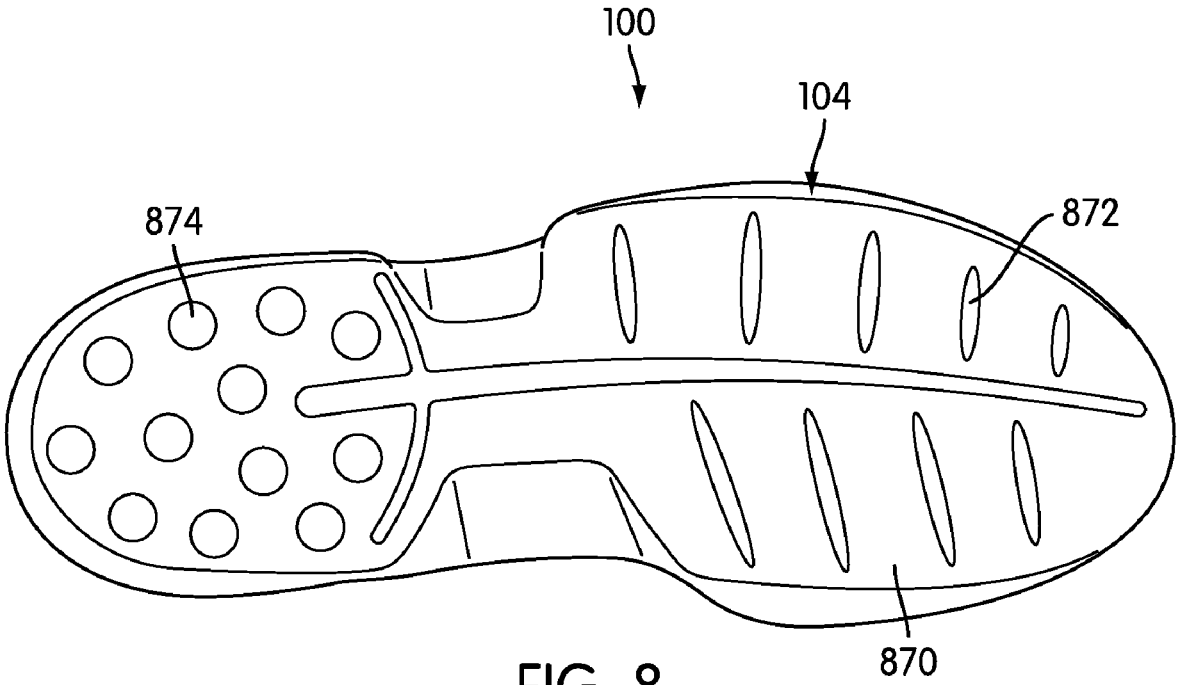
FIG. 8 is a schematic bottom view of a preferred embodiment of an article of footwear.

As seen in FIG. 7, outsole 104 includes a relatively thick and rounded heel 760 for absorbing heel impacts, such as when a fencer lunges forward. The thickness of heel 760 cushions the impact for comfort when the foot impacts a floor. The rounded shape of heel 760 promotes the rapid re-engagement of outsole 104 with the floor, as the foot is encouraged to rock forward into a stable position As seen in FIG. 8, outsole 104 includes a ground-engaging surface 870. Ground-engaging surface 870 is preferably smooth to allow a wearer to slide article of footwear 100 readily across a floor, track, or playing surface while still absorbing the shock of impacting the foot on the floor. Such functionality is desirable in sports such as fencing, where a combination of sliding and impacting ground-engaging surface 870 on a floor is common. Outsole 104 is preferably made from a material such as rubber or thermoplastic urethane (TPU), which can be readily molded, cut, or otherwise fashioned into a single, asymmetric component having various thicknesses over the contour of the piece. A suitable TPU is Desmopan® 9370AU from Bayer MaterialScience, which is injection moldable, free from plasticizers and phthalates, and is available in 70 Shore A hardness.

In some embodiments, no tread elements are provided. However, optional forefoot tread elements 872 and optional heel portion tread elements 874 may be included for aesthetic purposes or to reduce the weight of outsole 104. Optional tread elements 872, 874 are preferably indentations of any shape formed in ground-engaging surface 870. Optional forefoot tread elements 872 and optional heel portion tread elements 874 may be similar or the same shape or, as shown in FIG. 8, have different shapes.

Construction of article of footwear 100 is achieved by any means known in the art. For example, each component piece of article of footwear 100 may be manufactured separately and assembled on a last using known techniques to shape the components into any number of sizes and shapes, either for a custom fit or to conform to standard sizes. The components are then secured to each other as described above using known methods, such as stitching, with adhesives, heat welding, or the like.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper attached to a sole:

a bootie forming an interior of the upper;

an outer layer covering a substantial portion of the bootie;

the outer layer including an opening on a lateral side of the article of footwear;

the bootie attached to the outer layer only on a lateral side of the opening so that the bootie is otherwise unconstrained with respect to the outer layer and so that the bootie is displaceable with respect to the outer layer and the sole;

the opening formed through the outer layer to divide the outer layer into a medial portion having a medial edge and a lateral portion having a lateral edge, wherein the medial edge and the lateral edge bound the opening; and the opening having an adjustable portion and a fixed portion, wherein the medial edge and the lateral edge are affixed to at least one additional layer of the upper in the fixed portion.

2. The article of footwear according to claim 1, the sole including a rim that extends over a portion of the upper;

a notch formed in the sole, wherein the notch aligns with the opening;

the notch extending to a point proximate a bottom surface of the sole; and the opening extending to a sole-upper interface so that the notch accommodates a portion of the opening.

3. The article of footwear according to claim 1 further comprising a lacing system disposed proximate the opening.

4. The article of footwear according to claim 1, the asymmetric opening extending to the sole of the article of footwear in a toe region.

5. The article of footwear according to claim 1, wherein the bootie is detached from the outer layer at a sole-upper interface.

6. The article of footwear according to claim 1, further comprising a flap positioned between the outer layer and the bootie;

the flap attached to the bootie and the outer layer on only the lateral side of the opening.

7. The article of footwear according to claim 6, wherein the flap is attached to only the bootie on a medial side of the opening.

8. A fencing shoe comprising:

an upper including an outer covering having a split extending from a throat opening to a sole-upper interface in a toe region on a lateral side of the fencing shoe, wherein the split defines an opening having a width;

a cup outsole attached to the upper;

the cup outsole having a rim that extends over a portion of the upper around a perimeter of the upper;

a sliding surface formed by a portion of the cup outsole extending beyond the rim and partially over a toe region on a medial side of the fencing shoe, wherein the sliding surface is smoothly continuous with the rest of the cup outsole; and a notch formed in the rim of the cup outsole to expose the opening, wherein the notch extends from the upper surface of the rim to proximate a ground-engaging surface of the sole.

9. The fencing shoe according to claim 8, the outsole being rounded and thickened in a heel region of the fencing shoe.

10. The fencing shoe according to claim 8, wherein the portion of the outsole extending over the toe region is rounded.

11. The fencing shoe according to claim 8, wherein the outsole is made of a smooth, resilient material.

12. The fencing shoe according to claim 11, wherein the outsole is made of TPU.

13. The fencing shoe according to claim 8, further comprising an adjustment system disposed proximate the split for adjusting an opening of the split.

14. The fencing shoe according to claim 13, the adjustment system comprising a lacing system, a hook-and-eye closure system, or a slide fastener.

15. The fencing shoe according to claim 8, wherein a portion of the opening of the split is fixed so that the width of the opening is maintained.

16. The fencing shoe according to claim 8, wherein the split extends to a small toe region of the upper.

17. A multi-layered upper for an article of footwear comprising:

an inner layer configured to substantially encase a foot;

an outer layer covering at least a portion of the inner layer;

the outer layer having an opening disposed on a lateral side of the upper, wherein the opening extends from a foot insertion opening to a toe region on a lateral side of the upper, and wherein the inner layer is attached to the outer layer only on a lateral side of the opening;

the opening dividing the outer layer into a medial portion with a medial portion edge and a lateral portion with a lateral portion edge;

wherein the medial portion edge and the lateral portion edge define the opening, wherein a first portion of the opening has a first width and a second portion of the opening has a second width;

wherein the first width is adjustable and the second width is fixed;

a middle layer disposed between the inner layer and the outer layer;

the middle layer positioned underneath the opening;

wherein the middle layer is affixed to both the medial portion edge and the lateral portion edge in the second portion of the opening;

wherein the upper is configured to be attached to a sole having a rim, wherein a portion of the rim extends over a portion of the upper; and a gap formed in the rim, wherein the gap aligns with the opening.

18. The article of footwear according to claim 17, wherein the opening extends to a small toe region of the upper.

19. The article of footwear according to claim 17, wherein the opening extends to an upper-sole interface, and wherein the gap extends to proximate a ground-engaging surface of the sole.

20. The article of footwear according to claim 17, wherein the inner layer is displaceable relative to the outer layer.

21. The article of footwear according to claim 17, wherein the inner layer is detached from the outer layer on the medial side of the opening and at a sole-upper interface.

22. The article of footwear according to claim 17, wherein the inner layer is attached to the middle layer on a medial side and a lateral side of the opening.

* * * * *